US007237981B1

(12) United States Patent
Vitarelli

(10) Patent No.: US 7,237,981 B1
(45) Date of Patent: Jul. 3, 2007

(54) END CAP HAVING INTEGRAL PIPE STUB FOR USE WITH STORMWATER CHAMBER

(75) Inventor: Ronald R. Vitarelli, Hebron, CT (US)

(73) Assignee: StormTech, LLC, Wethersfield, CT (US)

( * ) Notice: Subject to any disclaimer, the term of this patent is extended or adjusted under 35 U.S.C. 154(b) by 0 days.

(21) Appl. No.: 11/031,281

(22) Filed: Jan. 7, 2005

Related U.S. Application Data

(60) Provisional application No. 60/534,955, filed on Jan. 8, 2004.

(51) Int. Cl.
*E02B 13/02* (2006.01)
*E02B 11/00* (2006.01)

(52) U.S. Cl. ..... 405/42; 405/40; 405/49; 210/170.03; 210/747; D23/260

(58) Field of Classification Search ..... 405/36, 405/40, 43–49, 42; 285/330, 331; 210/170.01, 210/170.03, 747; D23/200, 207, 260
See application file for complete search history.

(56) References Cited

U.S. PATENT DOCUMENTS 5,017,041 A * 5/1991 Nichols ..... 405/48
5,556,231 A * 9/1996 Sidaway et al. ..... 405/48
5,839,844 A 11/1998 Nichols et al. ..... 465/43
6,602,023 B2 * 8/2003 Crescenzi et al. ..... 405/42
6,698,975 B1 * 3/2004 Benecke ..... 405/43
6,854,925 B2 * 2/2005 DiTullio ..... 405/49
2002/0044833 A1 * 4/2002 Kruger et al. ..... 405/43
2004/0184884 A1 * 9/2004 DiTullio ..... 405/43
2005/0074285 A1 * 4/2005 Burnes et al. ..... 405/43

OTHER PUBLICATIONS

Product Catalog—Under Ground Stormwater Chambers Stormtech, Inc (2004) 4 pages.
Enviorchamber™ High Capacity Unit Endplate Brochure, Hancor, Inc. date unknown, 1 page.

* cited by examiner

*Primary Examiner*—Tara L Mayo
(74) *Attorney, Agent, or Firm*—C. Nessler

(57) ABSTRACT

A detachable end cap for a molded plastic storm water chamber has an integrally welded pipe stub. The stub cantilevers outwardly from the exterior surface of the end cap, which is preferably dome shaped, to enable connection to a line which carries water to or from the chamber. A polyethylene cap with stub and is used in combination with a polypropylene chamber.

13 Claims, 3 Drawing Sheets

END CAP HAVING INTEGRAL PIPE STUB FOR USE WITH STORMWATER CHAMBER

This application claims benefit of provisional patent application Ser. No. 60/534,955, filed Jan. 8, 2004.

TECHNICAL FIELD

The present invention relates to arch shape corrugation plastic chambers used to receive and disperse storm waters when buried beneath the earth surface.

BACKGROUND

Arch shape molded plastic storm chambers, such commercial StormTech Model SC310 and SC740 chambers (StormTech, LLC, Wethersfield, Conn.), are typically connected together end-to-end as strings. In a typical installation, an array of parallel rows of chambers is placed on a bed of gravel within a pit, and is then covered with layers of gravel and other material, such as soil or paving. During a storm, surface water which runs to catch basins is then channeled to the chambers, where it is received and detained. The water may be later discharged from the storm chamber array by percolation into the surrounding earth, or by flowing as runoff to a stream or the like. The ends of the chamber strings must be capped to prevent entry of the gravel or other particulate medium which surrounds the chambers. In the past, open-ended chambers used for stormwater have often been closed with flat or planar end-caps. The aforementioned StormTech chambers have been sold with end caps that have a convex exterior curve, often referred to as a dome shape.

A preferred way of conveying water to or from buried chambers is to run pipes through holes cut in the end caps. Common commercial pipes are made of polyethylene and may be corrugated or plain. Typically, to connect a pipe to an end cap, an installer cuts a hole in the end cap in the field, to the approximate size of the pipe which may range in outside diameter from 4 to 12 inches, or larger. He then inserts the pipe into the hole, so it projects into the chamber interior for what seems a suitable distance, for example 6 inches or more.

To facilitate the field-cutting of holes, the exterior surfaces of end caps have been provided with various-diameter embossed areas, to guide the installer where to cut. However, it is a problem that the installer does not do a good job in making the cut hole fit the pipe. With the preferred convex dome shape end cap, the hole has to be a curved ellipse, precluding the use of a circle cutter which might be used on a planar end cap. That has presented judgment problems as to the configuration of the hole, especially if the pipe entry location does not correspond with the manufacturer-provided embossing, or if the pipe runs at a horizontal or vertical plane angle to the length of the chamber. Another problem is that the installer may not have proper tools and may be working under adverse weather conditions. Those factors often result in gaps between the end cap wall and the pipe outside diameter, which can enable finer sized granular medium to enter the chamber.

When the pipe is corrugated, as is often the case, then some gap is inevitable. This can be understood from FIG. 3. The dashed line 27 indicates how the cut edge of the dome 23 of end cap 18 contacts the corrugated pipe 22A. It will be appreciated that, because of the valleys of the corrugation, no matter how good a job is done in making the curved ellipse hole, there will still be a path for entry of media.

Furthermore, when the pipe is put in place in the hole, if the bottom of the pipe is supported by a valley corrugation, as will likely happen, the pipe will lie eccentrically in the hole, with a gap at the top. That can allow granular medium, particularly finer particles, to enter the chamber through the gaps. The storage capacity of the storm chamber system can be compromised, and there might be some subsidence of the overlying material.

Another problem, particularly when the pipe diameter is large relative to the size of the end cap and associated chamber, is that a large hole in the end cap might significantly decrease the structural integrity of the cap and is capacity to resist the inward force of the surrounding media.

SUMMARY

An object of the invention is to provide an improved way of connecting a pipe to the end of an arch shape cross section storm water chamber. Another object is to provide an end cap for an arch shape cross section storm water chamber which cap has means for pipe connection which is strong, which prevents entry of gravel and the like, and which provide for connection to corrugated or plain pipe.

In accord with the invention, a molded thermoplastic end cap for an arch shape cross section storm water chamber has a flange portion which is adapted to mate with the end of said chamber, so the end cap closes off the end of the chamber to resist entry of media in which the chamber is buried during use. The end cap has a dome portion which runs across the chamber end from the flange. The dome portion forms the convex exterior surface of the end cap. A pipe stub, which may have various embodiments, is integrally welded to and cantilevers outwardly from the dome exterior surface, so that water can flow to or from the interior of the chamber. When the end cap has ribs, the pipe stub is welded to the ribs, so a strong structure is formed.

Preferably, the pipe stub has a smooth exterior wall where it is welded to the end cap and a corrugated outer, or cantilever end, for convenient connection to a corrugated line which delivers or carries away water from the chamber system. Preferably the end cap is wholly made of polyethylene and the chamber is made of polypropylene, to provide certain superior properties to the chamber while enabling the use of readily available polyethylene pipe as stubs. The stub diameter will typically range in outside diameter from 30-80% of the height of the end cap. While the end cap preferably has a smooth curve dome shape exterior, it may comprise planar outward sloping surfaces. An end cap with an approximately vertical exterior wall may be used in combination with a storm chamber which has and integral end wall. The end cap slips over the end of the storm chamber and water flows from the stub, through the space between the end cap wall and the integral end wall of the chamber, and through a hole in the integral end wall into the chamber interior.

The end cap of the present invention provides a strong structure, especially when the stub diameter is large relative to the end cap height, and is easy and convenient to use.

The foregoing and other objects, features and advantages of the present invention will become more apparent from the following description of preferred embodiments and accompanying drawings.

DESCRIPTION

Exemplary commercial chambers with which the present invention is useful are the aforementioned StormTech chambers. Such chambers have been sold in combination with dome shape end caps; both have been made of polypropylene. Chambers and end caps are described in U.S. patent application Ser. No. 09/849,758 of Krueger et al., filed May 4, 2001, now U.S. Pat. No. 7,118,316, the disclosure of which is hereby incorporated by reference. The corrugated molded plastic chambers have arch shape cross sections, the curve of which is continuous and preferably comprises a truncated ellipse. The chambers have interior cavities for receiving and holding storm water, and open bottoms and perforated sidewalls which enable the storm water received to flow away. The commercial end caps look like those pictured in FIGS. 1-4, except that they lack the integral pipe stub of the present invention. With reference to the Figures, the commercial end caps and certain preferred end caps of the present invention have both a convex domed exterior and internal ribbing 40, both of which provide superior strength.

Figure 1:
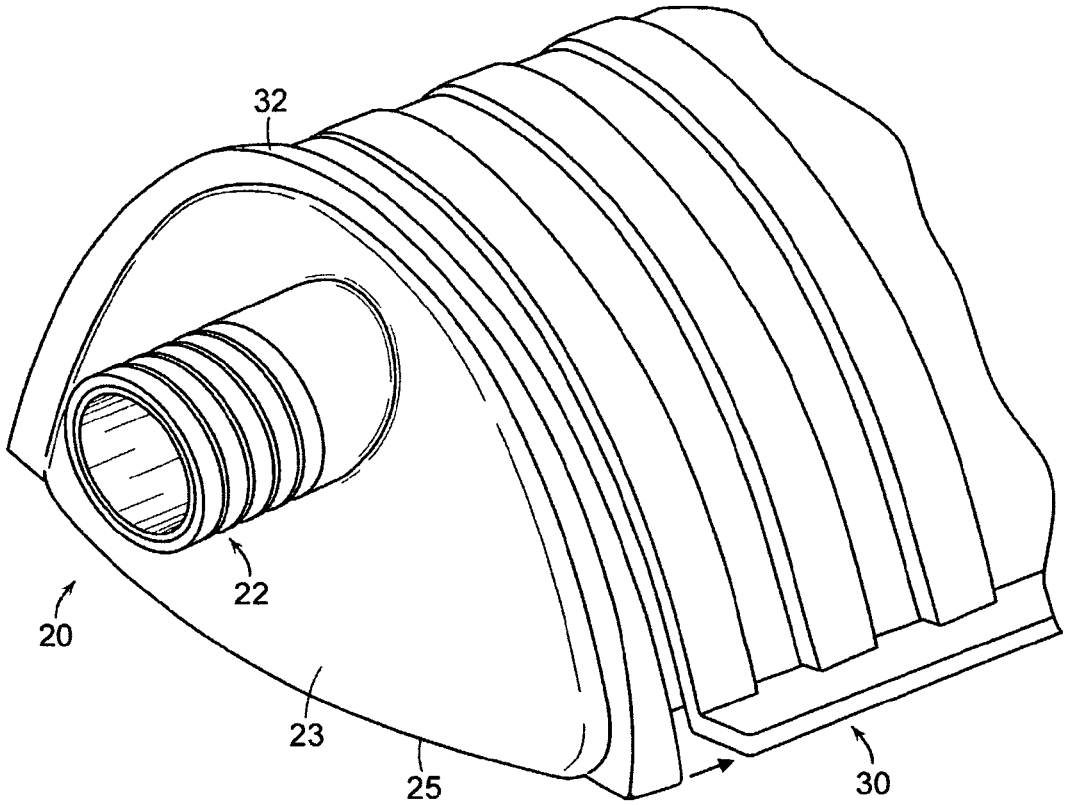
FIG. 1 is an isometric view of molded plastic end cap having an integral pipe stub connector, as it appears to close the end of an arch shape cross section molded corrugated plastic storm chamber.

FIG. 1 shows an embodiment of end cap 20 of the present invention. The cap is comprised of dome 23, namely an exterior surface portion which has a convex curved shape and, preferably, the aforementioned internal ribbing. The dome 23 closes off the end of a chamber and prevents entry of the surrounding medium. Arch shape flange 32 is connected to the upper periphery of the dome. It enables the end cap to detachably fit within the end of an open-ended arch shape cross section corrugated storm chamber 30. In alternative embodiments, the end cap 20 may overlap the end of the chamber or be overlapped by it. The end cap has a base 25 which supports it upon the same material upon which the chamber rests.

Figure 2:
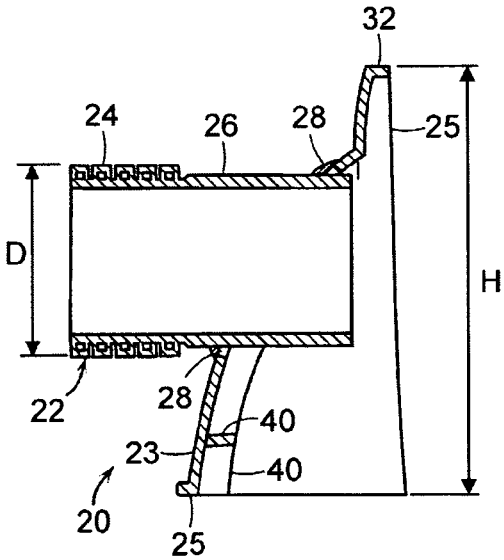
FIG. 2 is a vertical center plane cross section view of the end cap of FIG. 1 showing how the pipe stub is welded to the cap.
Figure 3:
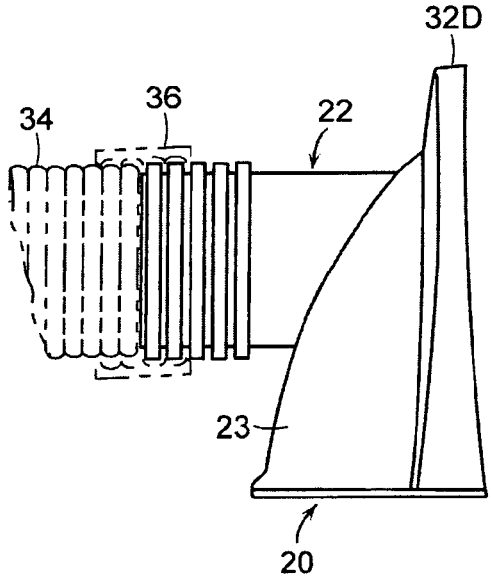
FIG. 3 is a side elevation view of an end cap, similar to that shown in FIG. 1, having a welded pipe stub which is both plain and corrugated, connected to a corrugated pipe shown in phantom.
Figure 4:
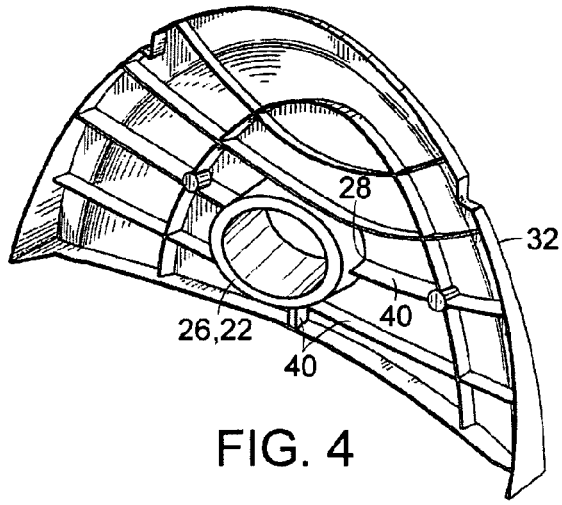
FIG. 4 shows the interior of a ribbed dome shape end cap having pipe stub which is welded to the ribs and dome exterior.

FIG. 2 shows a vertical centerline cross section through the cap 20 of FIG. 1. Round pipe stub 22, which has a nominal outside diameter D, is comprised of a plain, or solid smooth wall, section 26 and opposing corrugated end 24. As illustrated shown in FIG. 2, the smooth wall portion is in contradistinction to the corrugated wall portion; and, the smooth wall section has substantially constant diameter alone the section length; in contrast the corrugated wall section has a diameter which varies from point to point along the corrugated section length. The plain end 26 is attached by weld 28 to the end cap. The corrugated outer end 24, which has a preferred smooth inner wall, is cantilevered into space. FIG. 3, which shows the end cap of FIG. 2 in side elevation view, illustrates how, by use of a suitable commercial coupling 36, a matching diameter corrugated pipe 34, shown in phantom, can be connected to the end 24 of the stub 22.

Preferably, stub 22 and dome 20 are made of polyethylene, as described further below. Using common thermoplastic welding technology, stub 22 is welded into the dome, both at the location where it fits the hole in the dome exterior surface and where the stub intercepts ribs running along the dome interior. See FIG. 4. Thus, the structure of the stub 22 adds strength to the dome, in comparison to the situation that exists when there is no weld, as in the prior art. Preferably, the portion of stub 22, and other variations described herein, which is welded to the end cap has a wall thickness which comports with Schedule 10, 20 or 40 piping.

The stub may be at any elevation and may run at an angle to the longitudinal axis of the cap (which by definition corresponds with the longitudinal axis of an associated chamber). The stub may be curved, for example like a sweep elbow, so the terminal end of the stub which connects to a pipe runs at an angle to the longitudinal axis of the cap. The corrugated end 24 of the stub may be longer than shown and may be provided without the smooth inner wall, to make the stub more bendable, so the angle between the opposing ends of the stub can be varied, to enable easier connection to a pipe which runs toward the cap at an oblique angle.

Figure 5:
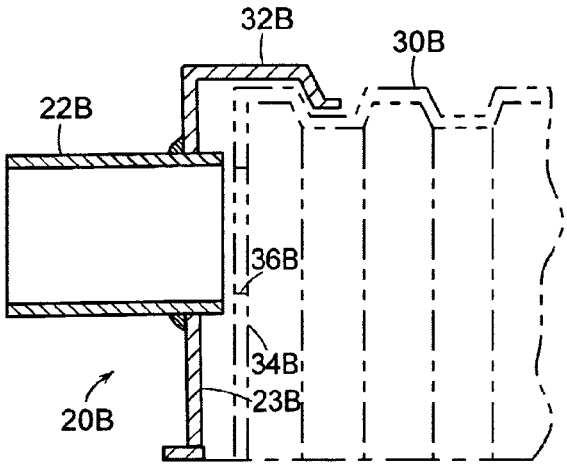
FIG. 5 is a view like that of FIG. 2, showing an end cap having planar wall to which an integral stub is attached.

FIG. 5 shows end cap 20B, which has an approximately or substantially vertical planar exterior, in comparison to the dome end cap just described. In one embodiment, the end cap is used as just described, to overlap or underlap, and thus close off the open end of any open-end arch shape cross section chamber. As illustrated by FIG. 5, end cap 20B may be used for easier and better connection of a pipe to a chamber which has an integral end wall 34B, as shown for the phantom chamber 30B. Storm water chambers with integral end caps are shown in U.S. Pat. No. 5,087,151 of Detullio, and are sold in commerce, for instance as Cultec Model 330 chambers. The disclosure of said patent is hereby incorporated by reference. In FIG. 5, the end cap is not needed for closing off the open interior of the chamber. Instead, the end cap is slipped over the end of the chamber which has previously cut hole 36B in end wall 34B. Thus, a the hole 36B does not have to be carefully cut in the integral end wall, in order to prevent entry of the surrounding medium. In use, water flows through the stub, into the space between the end cap wall and the integral end wall, and then into the chamber interior.

FIG. 5 also shows how stub 22B may be entirely a smooth wall pipe, to which another pipe may be connected using familiar metal banded rubber couplings, for instance, a Fernco coupling. All-smooth wall stubs may be used with the other end cap embodiments described herein. And other stub embodiments may be used with the FIG. 5 end cap.

Figure 6:
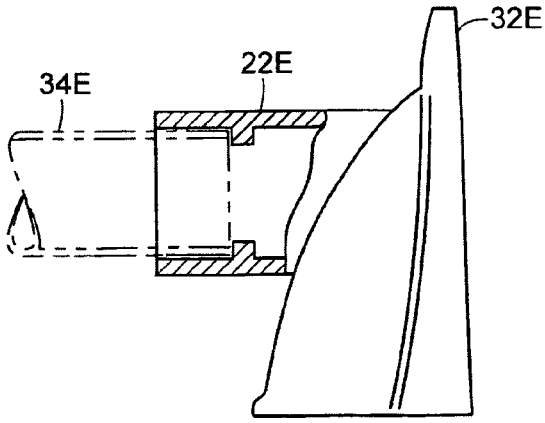
FIG. 6 is a side elevation view similar to FIG. 4 showing a partially cut-away integral stub which is a coupling.

Another pipe stub embodiment is illustrated by FIG. 6. Stub 22E is a coupling which receives a pipe 34E, shown in phantom, within its bore. In another embodiment, not shown, the whole stub exterior is corrugated. The stub may or may not have a smooth inner wall. However, such all-corrugated exterior is less preferred because of the difficulty presented in getting a continuous weld where the corrugation valleys intersect the dome parts, and because of the inferior strength which is provided to the finished end cap structure, due to the flexibility of corrugated pipe. In still another embodiment, the outer end of the stub may have a larger or smaller diameter than the inner end of the stub which is welded to the exterior surface.

Commercial StormTech storm chambers are presently made of polypropylene, because of certain material property and performance advantages over polyethylene chambers, in particular, better creep rupture strength. The end caps sold heretofore, for use with such chambers, are likewise made of polypropylene. On the other hand, most commercial pipe used for storm water is made of polyethylene, typically high density polyethylene (HDPE). That may be attributed to general popularity, economics, and good properties including impact resistance. When, as in the past, a polyethylene pipe has been connected to an end cap, by slipping the pipe into a circular opening, the difference in materials is not significant. However, welding polyethylene to polypropylene does produce good welds. So, making a pipe stub integral with an end cap was not previously an option. And in the present preferred invention, the whole of the end cap is made of HDPE, and the chamber is made of polypropylene. In another embodiment, the end cap including integral stub is made of polypropylene and the chamber is made of polypropylene. An end cap of the present invention may be made as one molded piece instead of being a weldment. However, mold, manufacturing and inventory costs strongly work against such.

As an example, a nominally semi-circular dome shape end cap has a height of 16 inch and a base width of 34 inch; and the stub pipe connector may be 4-8-12 inch diameter. In another example, the end cap is approximately 30 inch high by 51 inch base width, and the nominal stub pipe diameter may range from 8 inch diameter or smaller to 24 inch diameter. In the invention, the stub pipe nominal outside diameter D, where it is welded to the end cap, will preferably be at least 20-80% of the nominal height H of the end cap (which H is also the nominal height of the associated chamber). See FIG. 2.

In a preferred embodiment, a stub will extend at least 12 inches (or about 1.5 to 0.5 pipe diameters, for a 8 inch stub or 24 inch stub pipe, respectively) outwardly from the exterior surface of the dome, measured at mid-elevation of the stub where it intersects the dome exterior. Preferably, the top edge of the stub extends into the interior of the end cap at least to the depth of any rib on the end cap interior.

Figure 7:
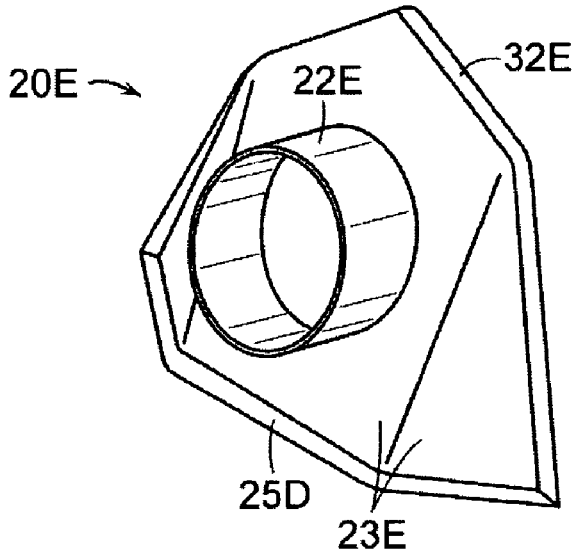
FIG. 7 shows a dome end cap having sloped planar walls instead of continuous curve wall.
Figure 8:
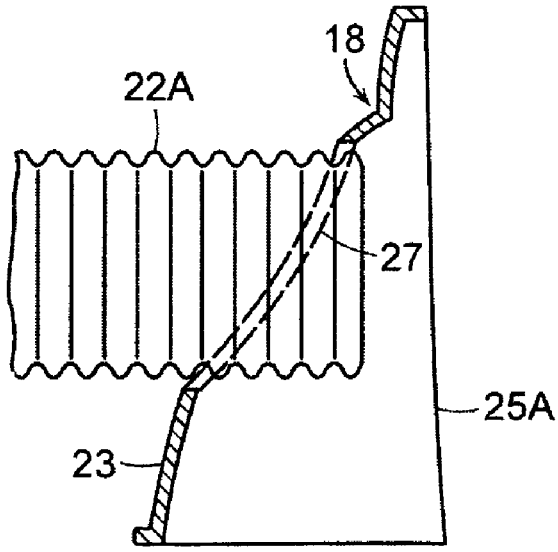
PRIOR ART FIG. 8
FIG. 8 is a view like that of FIG. 2, showing a corrugated pipe inserted in a hole cut in an end cap, according to the practice of the prior art.

The arch shape of an opened ended corrugated leaching chamber may have other shapes than the continuous semi-elliptical curve which characterizes the Kruger et al. patent and StormTech chambers. For example, the chamber cross section may be comprised of planar walls with a curved top, as has characterized certain leaching chambers. See U.S. Pat. No. 5,017,041. While a circular pipe stub for connecting to drain pipes of similar dimension is most common, within the scope of the invention other cross section stubs may be used. The exterior of a dome end cap is preferably a smooth convex curve, as shown in the different embodiments here. In the generality of the invention, the exterior end dome surface may have other forms. For instance, as shown in FIG. 7, end cap 20E may comprise a dome portion 23E which is formed from several intersecting planar surfaces In another alternative, not shown, the dome portion may comprise compound intersecting curved sections. In the generality of these embodiments, the end cap wall in vicinity of the welded stub will slope outwardly in the vertically down direction relative to the portion which is adapted to attach to a chamber.

Benefits of the present invention include that there is less installer work in the field and less questions about quality of the connections which are made. While end caps of the present invention can be made by molding the stub and rest of the end cap as one piece in a plastic injection mold, it is preferable that end caps be fabricated in the manufacturer's shop as customer requirements become known, so that desired pipe diameter and elevation and angling can be provided. That avoids inventory and minimum run size problems which would be present with end caps which have integrally molded stubs.

Although this invention has been shown and described with respect to one or more embodiments, it will be understood by those skilled in this art that various changes in form and detail thereof may be made without departing from the spirit and scope of the claimed invention.

I claim:

1. A thermoplastic end cap, for an arch shape cross section storm water chamber having an interior cavity for receiving storm water, the chamber having an arch-end for receiving an end cap, and an open bottom and perforated sidewall for enabling outward flow of storm water introduced into the interior cavity during use, which comprises:

a dome portion, for closing off said arch-end of a chamber for preventing the entry of gravel or other particulate material which surrounds a storm water chamber during use into said interior cavity, the dome portion presenting a convex exterior surface when the cap is attached to said arch-end of said chamber;

a flange portion, running along an arc path around the periphery of said dome portion, for attaching the end cap to said arch-end of a chamber; and, a pipe stub, having a first end extending into said interior cavity and having an exterior surface which is smooth, substantially constant in diameter along its length and free of corrugations, which first end is integrally attached to the dome portion by plastic weld material; the stub having a second end which cantilevers outwardly from the convex exterior surface of the dome portion, for carrying water to or from said interior cavity of said chamber when the end cap is attached to the arch-end of said chamber.

2. The end cap of claim 1, further comprising a plurality of strengthening ribs running along the interior of the dome portion; wherein said first end of the pipe stub is integrally attached by plastic weld material to a multiplicity of said interior ribs, to thereby provide strength to the dome portion.

3. The end cap of claim 1 wherein said pipe stub second end has a corrugated exterior surface.

4. The end cap of claim 3 wherein the first pipe stub end is rigid and wherein said corrugated exterior surface of said second pipe stub end is bendable, so that the angle between the second end and the first end can be varied.

5. The end cap of claim 1, wherein the dome, flange and pipe stub portions are made of polyethylene, in combination with an arch shape cross section storm water chamber made of polypropylene; wherein the end cap is engaged with the end of the chamber by means of said flange portion.

6. The end cap of claim 1 wherein the nominal outside diameter of the pipe stub is 20-80% of the height of the end cap as measured from the portion of the end cap which corresponds with the base of a chamber when the end cap is attached to a chamber; and, wherein the pipe stub extends outwardly from the exterior surface of the dome portion for a length of at least 0.5 pipe stub diameters.

7. The end cap of claim 1 wherein said exterior surface of the dome portion is curved.

8. Apparatus for receiving and dispersing storm water beneath the surface of soil which comprises:

(a) a corrugated arch shape cross section polypropylene storm water chamber having an interior cavity for receiving storm water, the chamber having an open bottom and perforated sidewall for enabling outward flow of storm water introduced into the cavity by flowing through the end cap when the end cap is attached to the arch-end of the chamber; and, (b) a one-piece polyethylene end cap, engaged with said arch-end of the chamber by means of a flange, the end cap closing off said arch-end of the chamber, which end cap comprises (i) a dome portion, for closing off the arch-end of a chamber for preventing the entry of gravel or other particulate material which surrounds the chamber during use, the dome portion presenting a convex exterior surface when the cap is attached to the end of said chamber;

(ii) a plurality of strengthening ribs running along the interior surface of the dome portion, to strengthen the end cap;

(iii) a flange portion, running along an arc path around the periphery of the dome portion, for attaching said end cap to said open end of said chamber; and, (iv) a pipe stub, cantilevering outwardly from the convex exterior surface of the dome portion, for carrying water to or from the interior of the chamber; the pipe stub having a first end extending into said interior cavity, said first end having an exterior surface that is smooth and substantially constant in diameter along its length, which first end is integrally attached to both the convex exterior surface of the dome portion and to a multiplicity of said strengthening ribs by plastic weld material; and, a second end which cantilevers outwardly from the convex exterior surface of the dome portion, for carrying water to or from the interior space of the chamber when the end cap is attached to the open end of the storm water chamber; the a second cantilever end having a corrugated exterior surface portion.

9. The end cap of claim 8 wherein said second pipe stub cantilever end is bendable, so that the angle between the second end and the first end can be varied.

10. Apparatus for receiving and dispersing storm water beneath the surface of soil which comprises:

(a) a thermoplastic corrugated arch shape cross section storm water chamber having an integral end wall with one or more openings for passage of water;

(b) a one-piece thermoplastic storm water end cap, wherein the cap comprises (i) a wall portion, providing an exterior surface of the end cap, the wall portion generally corresponding in dimension with an external dimension of the integral end wall of the chamber;

(ii) a flange portion, running along an arch path around the wall portion, for engaging the end cap with the end of said chamber;

wherein said flange portion is attached to the exterior of the end of said chamber, so that the flange portion encompasses the end of the chamber and so said end cap wall portion is spaced apart from said integral end wall, to thereby define a space between said wall portion and the integral end wall of the chamber; and, a pipe stub, having a first end extending into the interior cavity of the chamber and having an exterior surface which is smooth, substantially constant in diameter along its length, which first end is integrally attached to the wall portion by plastic weld material; the stub having a second end which cantilevers outwardly from said wall portion and away from said space between said wall portion and the integral end wall of the chamber, for carrying water to or from said space.

11. The apparatus of claim 10 wherein said second end has a corrugated exterior portion.

12. The apparatus of claim 11 wherein the first pipe end is rigid and the second pipe stub end is bendable, so that the angle between the second end and the first end can be varied.

13. The apparatus of claim 10 wherein the end cap is made of polyethylene and the storm chamber is made of polypropylene.

* * * * *